United States Patent [19]

Dugger, Jr.

[11] 4,243,182

[45] Jan. 6, 1981

[54] LINER ASSEMBLY FOR BALL MILLS

[75] Inventor: Charles B. Dugger, Jr., Plymouth, Minn.

[73] Assignee: Minneapolis Electric Steel Castings Company, Minneapolis, Minn.

[21] Appl. No.: 25,206

[22] Filed: Mar. 29, 1979

[51] Int. Cl.[3] ..... B02C 17/22

[52] U.S. Cl. ..... 241/153; 241/183

[58] Field of Search ..... 241/153, 181–183, 241/284, 299

[56] References Cited

U.S. PATENT DOCUMENTS

| | | |
|---|---|---|
| 2,470,315 | 5/1949 | McLehee . |
| 2,661,908 | 12/1953 | Slegten . |
| 2,731,210 | 1/1956 | Henricot . |
| 2,743,060 | 4/1956 | Daman . |
| 2,885,155 | 5/1959 | Frankert . |
| 2,967,671 | 1/1961 | Falla . |
| 3,630,459 | 12/1971 | Slegten . |

FOREIGN PATENT DOCUMENTS 325566 12/1957 Switzerland ..... 241/183

*Primary Examiner*—Howard N. Goldberg

*Attorney, Agent, or Firm*—Merchant, Gould, Smith, Edell, Welter & Schmidt

[57] ABSTRACT

The disclosure is directed to a multiple zone liner system for the cylindrical shell of a ball mill. The liner system comprises a plurality of liner sections which are constructed for mounting on the inner shell surface of the mill in sequential relation along its rotational axis. Each liner section is formed with a plurality of elevated ridges disposed in substantial alignment with the shell access, and which are circumferentially spaced therearound to define a comminuting surface. Each ridge defines a lifting surface that is disposed at a predetermined angle relative to a radius of the shell, and each ridge has a predetermined lifting dimension. The number of ridges of each liner section increases from section to section from the inlet to the outlet of the mill. The angle of the lifting surfaces of the ridges also increases from section to section toward the mill outlet. The lifting dimension of the ridges decreases from section to section from the mill inlet to the outlet. The result is a liner system capable of comminuting ore with greater effectiveness and efficiency.

26 Claims, 13 Drawing Figures

LINER ASSEMBLY FOR BALL MILLS

TECHNICAL FIELD

The invention generally relates to ore comminuting ball mills, and is specifically directed to a multiple zone or section liner system for the shell of a ball mill in which each liner section has a profile of different configuration.

BACKGROUND OF PRIOR ART

Ball mills are commonly used as one step in the process of reducing the size of ore in commercial mining operations. A ball mill typically consists of a large cylindrical drum mounted on bearings for rotation about a substantially horizontal axis and driven by a powerful motor through conventional reduction gearing. The axial ends of the drum are open, and the ore which is to be comminuted is continuously fed into the mill at one end with the product of reduced size continuously emerging from the other end.

In conventional ball mills, comminution occurs by the balls falling and tumbling onto the ore fragments as the drum is rotated. In an operation of this type, 40–50 percent of the overall charge consists of balls. The term "ball mill" also encompasses a semiautogenously operated mill, in which 2–15 percent of the total charge is balls. In a semiautogenous operation, part of the ore is comminuted by the balls, and part is self comminuted.

Generally, several steps are required to reduce the ore from the larger, randomly sized fragments resulting from the mining operation. Each step requires large, heavy and sometimes complex equipment which represents a high initial cost and requires substantial energy (usually electrical) to operate. Ball mills, some of which are operated semiautogenously, constitute one type of equipment. Other types include rod mills, autogenous mills (in which the ore is self-comminuted by tumbling in a drum or the like), gyratory crushers and roll crushers. Each of these different types of machines is ordinarily used to reduce the ore fragments or particles in a particular size range, and all may be necessary in a particular comminuting process.

It is presently known to employ more than one reducing zone in ball mills. The multizone concept increases the efficiency of the comminuting process because it performs more than one reducing step with a single piece of equipment. However, in order to effect the proper gradation of the ore fragments or particles, and to prevent larger particles from passing into subsequent zones before being properly reduced in size, these ball mills are compartmented through the use of sizing screens. Accordingly, the fragments are tumbled in a particular zone until they have been reduced to a size which permits them to move through the grading screen to the next zone.

As of the present time, the multizone concept has not been possible with semiautogenous mills. Whereas the usage of balls increases the efficiency of a comminuting process by crushing, nipping and rolling the ore fragments to a reduced size, they tend to destroy any grading screen which is used to retain the fragments in a given zone. Accordingly, to my knowledge, there are no multiple zone semiautogenous mills in the prior art.

BRIEF SUMMARY OF THE INVENTION

My invention is specifically directed to a semiautogenous ball mill having a liner assembly for the rotating drum which defines a plurality of zones. The liner assembly is constructed and arranged so that the ore moves sequentially from one zone to the next. Each zone has a profile of different configuration, and each is specifically designed to reduce the ore fragments to a given size, after which the ore moves or migrates to the next zone.

In the preferred embodiment, each zone comprises a liner subassembly or section which is cylindrical in shape and lines a predetermined axial length of a cylindrical rotating drum or shell. The liner subassemblies or sections are preferably of equal axial length; e.g., if three zones are used in the cylindrical drum, each occupies one-third of the drum length.

Each of the liner sections is formed with a plurality of elevated ridges which project radially inward and extend in general alignment with the shell axis. The ridges are circumferentially spaced around the inner cylindrical surface of the drum to define an ore comminuting surface. The number of ridges per liner section increases in the direction of ore flow (inlet to outlet).

Each ridge defines a lifting surface that is disposed at a predetermined angle relative to a radius of the drum. The angle is constant for the ridges in a given liner section, but the angle increases from section to section in the direction of ore flow.

Each ridge also defines a predetermined lifting dimension (i.e., the height of the internally projecting ridge) which is constant in each liner section, but which decreases from section to section in the direction of ore flow.

The first liner section includes the least number of elevated ridges. Each ridge has a more severe lifting angle (i.e., the lifting surface more closely approaches a radius of the cylindrical drum than the other ridges) and its lifting dimension causes it to project internally a greater distance than that of the other ridges. Accordingly, the large ore fragments which are received from the inlet are carried higher as the liner section rotates. With the added effect of the balls, which are also carried upward with rotation, comminution results from the impact of the ore fragments falling on other ore fragments and balls below, and from the balls dropping on ore fragments.

In the second zone, the number of elevated ridges increases because the size of the ore fragments has been reduced by one order of magnitude. The lift angle is increased relative to the drum radius, so that the fragments and balls fall more easily from the ridges. Coupled with a decreased lifting dimension, the ore fragments are not carried as high with rotation of the drum as in the first zone, and the comminution process more closely resembles tumbling, as distinguished from fragmentation by dropping impact as in the first zone. In the second zone, there is a greater tendency for the balls to nip the ore fragments and thus reduce them in size.

In the third zone, the number of ridges is again increased, the lift angle further increased and the lifting dimension further decreased. This gives rise to a more gentle tumbling or rolling effect for the already reduced fragments, further reducing them to small particulate size. The comminuted product is discharged from the outlet in this form.

I have found that the approach of comminution of ore by passing it through a plurality of comminution zones in a noncompartmented ball mill is more efficient than in prior art devices. Efficiency is usually referred to in terms of throughput per kilowatt-hour.

Another feature of the invention is that the ore fragments and balls migrate from one zone to another automatically as they become smaller. This is believed to result at least in part from an effective decrease in rotational velocity from one zone to the next in the direction of ore flow, coupled with the structural variations from section to section as described above. This decrease in rotational velocity results from a decrease in the effective diameter from zone to zone in the direction of ore flow. This is accomplished by increasing the base thickness of each liner section relative to the preceding section. The resulting classification of both ore fragments and balls into the appropriate comminuting zones is also a factor in the increased efficiency of the process. It also insures that a fresh charge of balls will remain in the first zone until they become smaller through wear.

Additional features and advantages of the invention will become apparent from the drawings and description below.

DETAILED DESCRIPTION OF THE INVENTION

Figure 1:
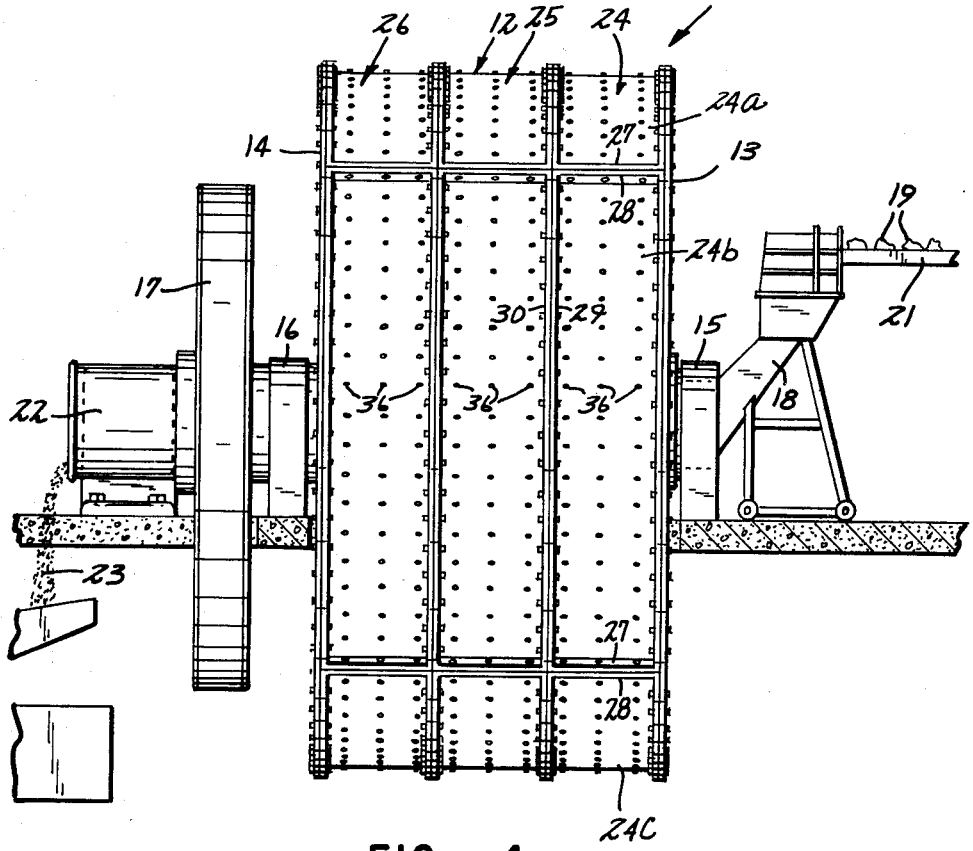
FIG. 1 is a somewhat schematic view in side elevation of a semiautogenous ore grinding mill in which the inventive multiple section liner assembly is used.

With initial reference to FIG. 1, a semiautogenous mill employing the inventive multiple zone or section liner assembly is referred to generally by the numeral 11. The mill 11 includes a hollow cylindrical drum or shell 12 having end walls 13, 14 with large central axial openings (not shown) and arranged for rotation about a substantially horizontal axis in suitable bearings 15, 16 by a drive of conventional nature and a suitable housing 17. A chute 18 communicating with the axial inlet receives ore fragments 19 from a conveyor 21. The comminuted material leaves the drum 12 through the opposite axial opening in end wall 14, and is discharged from the mill 11 through an outlet 22. The fully comminuted ore is represented by reference numeral 23.

Cylindrical drum 12 is made up of a plurality of cylindrical sections 24–26, each of which is in turn assembled from a set of cylindrical quadrants by bolts extending through axial flanges. For example, section 24 consists of quadrants **24*a*–24*c* (one quadrant is not shown) which are secured together circumferentially by a plurality of bolts passing through radially extending, axially aligned flanges 27, 28. The cylindrical sections 24, 25 are secured together axially by a plurality of bolts passing through circumferential flanges 29, 30 extending radially from the periphery of each side. Cylindrical sections 25, 26 are secured in an identical manner, as are the end walls 13, 14 to the cylindrical sections 24, 26**, respectively.

Each of the cylindrical sections 24–26 of drum 12 is formed with a plurality of liner mounting holes 31 which are positioned in a pattern defining axial rows, the rows being spaced equiangularly about the drum, and in circumferential rows which are equidistantly spaced within each of the sections 24–26.

Figure 4:
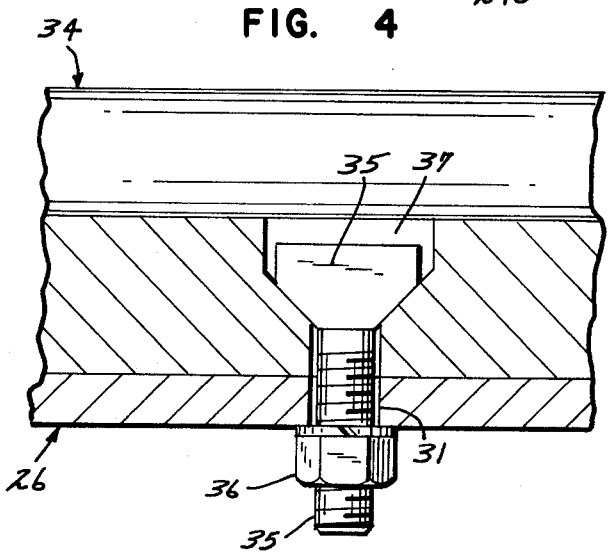
FIG. 4 is an enlarged fragmentary sectional view of the means for fastening a liner segment to the drum or shell, as taken along the line 4—4 of FIG. 2.
Figure 2:
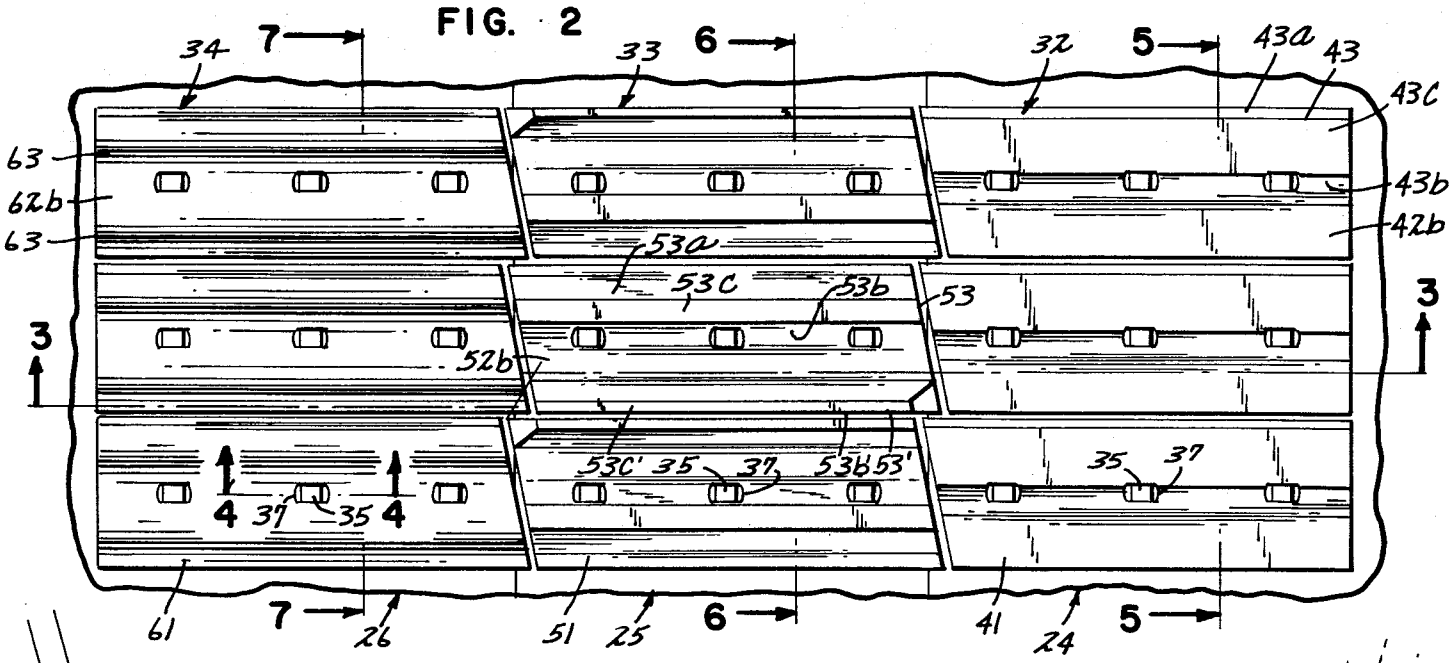
FIG. 2 is an enlarged fragmentary view showing the multiple zone liner assembly of the grinding mill according to the invention and viewed radially outward from within the mill.
Figure 3:
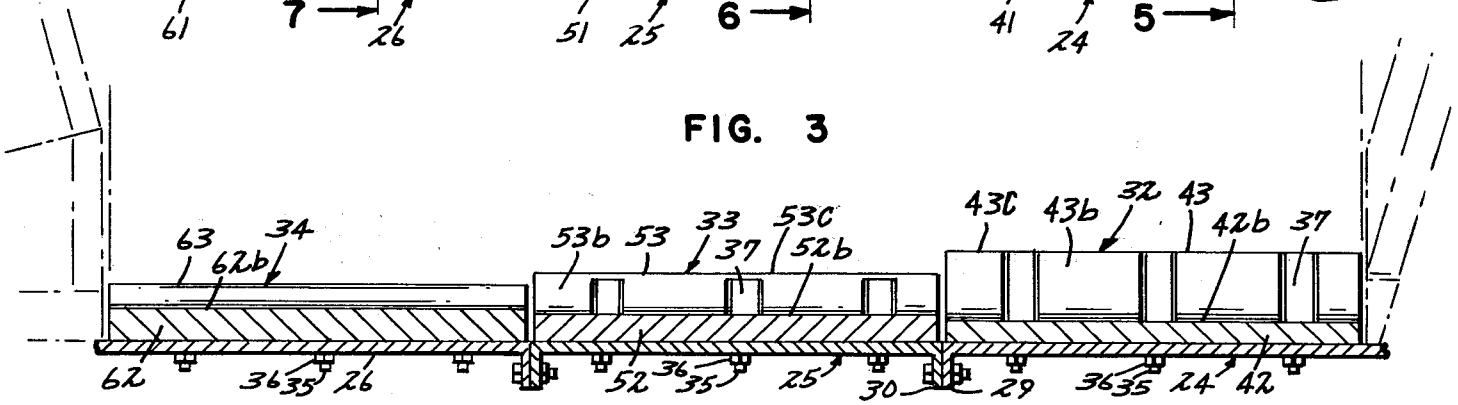
FIG. 3 is a sectional view of the multiple zone liner assembly taken along the line 3—3 of FIG. 2, showing in particular the relative difference in size of the individual liner segments between grinding zones, and the fastening of the liner segments to the cylindrical drum or shell of the mill.

With additional reference to FIGS. 2–4, an inner circumferential liner assembly for the drum 12 is bolted to the drum 12 to virtually cover its inner cylindrical surface. The inner circumferential liner assembly comprises three separate liner sections for the respective cylindrical sections 24–26, which bear reference numerals 32–34, respectively. For reasons of manufacturing simplicity and ease of liner replacement, each of the liner sections 32–34 comprises a subassembly of individual liner segments respectively numbered 41, 51, 61. With particular reference to FIG. 2, each of the liner segments 41, 61 defines an outer end which is perpendicular to the segment longitudinal axis and parallel to the end walls 13, 14 of drum 12. The inner ends of each of these segments 41, 61 are truncated to complement the ends of the adjacent segments 51, which are trapezoidal in shape.

Each of the liner segments, 41, 51, 61 is mounted to the shell by mounting bolts 35 and nuts 36. FIG. 4 is an enlarged sectional view showing the mounting of one of the segments 61, which is typical. Each segment is formed with three countersunk bores 37 that are registrable with the liner mounting holes 31 to receive the bolts 35. The enlarged head of the bolt 35 has flat, parallel sides, and the countersunk portion of the bore 37 is shaped accordingly (see FIG. 2). This insures that the bolt 35 will not turn when the nut 36 is tightened during installation or loosened during replacement. The beveled underside of the bolt head and the corresponding bevel of the countersunk recess insures that the segment 61 is drawn tight and flush to the inner mounting surface of the drum 12.

Figure 5:
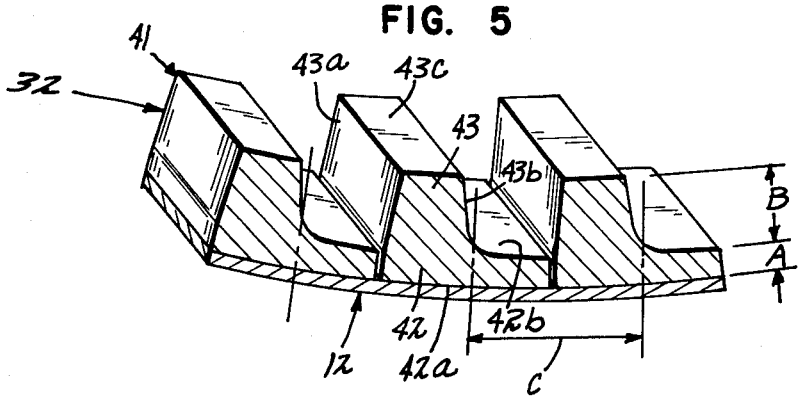
FIG. 5 is a perspective sectional view of several individual segments of the first comminution zone as generally taken along the line 5—5 of FIG. 2.
Figure 6:
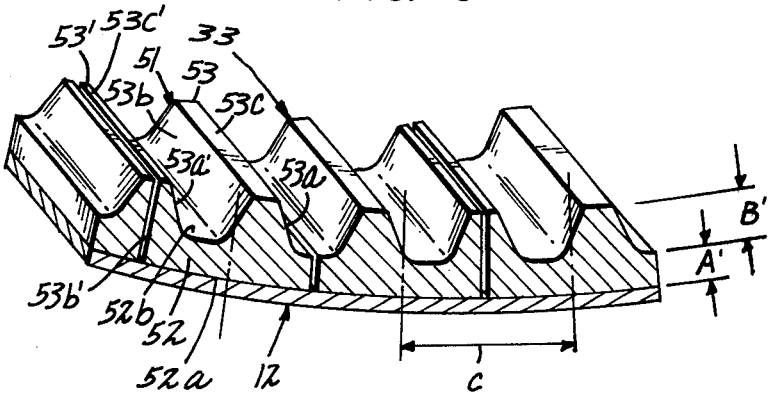
FIG. 6 is a perspective sectional view of several individual segments of the second comminution zone as generally taken along the line 6—6 of FIG. 2.
Figure 7:
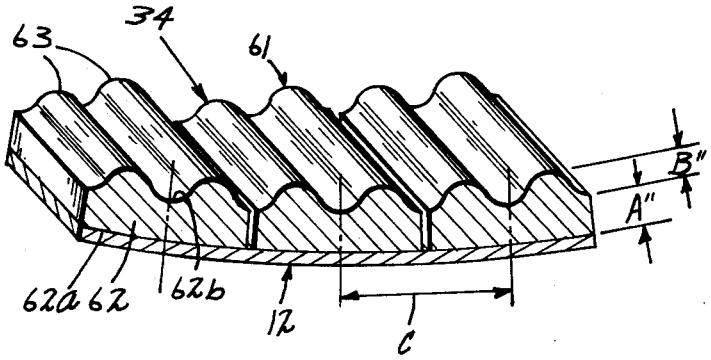
FIG. 7 is a perspective sectional view of several individual segments of the third comminution zone as generally taken along the line 7—7 of FIG. 2.
Figures 8, 9, 10, 11, 12, 13:
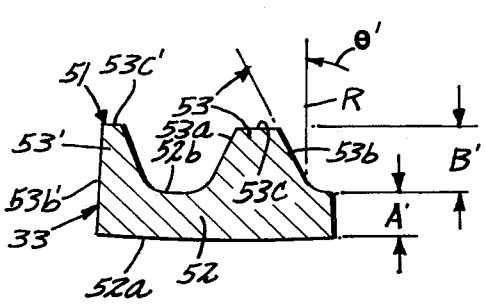
FIGS. 8–10 are enlarged sectional views of the individual liner segments for the first, second and third grinding zones, respectively.
FIGS. 11–13 are schematic representations of the material mass profiles in the first, second and third grinding zones, respectively.

FIGS. 5–7 disclose each of the liner sections 32–34 in perspective. FIGS. 8–10 are sectional views of the individual segments 41, 51, 61 which make up the liner sections.

With reference to FIGS. 5 and 8, each of the liner segments 41 comprises a body defining a base 42 and a ridge 43 which projects upwardly from the base at one side thereof. The base 42 defines a slightly arcuate undersurface **42*a* that mounts flush with the inner cylindrical surface of the shell 12. The height or thickness of base 42 is represented by A, and the distance which ridge 43 projects above base 42 (the lifting dimension) is represented by B. Apart from the base 42, the ridge 43** is symmetrical and defines identical substantially flat sides 43*a*, 43*b*, each of which subtends an angle $\theta$ relative to a true radius of the shell 12, which appears as the vertical line R in FIG. 8. The top surface of ridge 43 is flat, as shown at 43*c*, and side 43*b* blends smoothly into the upper surface 42*b* of base 42.

With specific reference to FIG. 5, the "tail" of segment 41 (i.e., that portion of base 42 extending laterally from side 43*b*) defines the spacing between elevated ridges 43 when the segments are mounted in side-by-side relation. An ore carrying recess (defined by opposed sides or faces 43*a*, 43*b* and the upper surface 42*b* of base 42) is disposed between each of the ridges 43. The size of the recess between ridges 43, which permits the carrying of larger ore fragments, is determined by the numer of ridges and the spacing therebetween. As shown in FIG. 5, there is one elevated ridge 41 for a given chordal distance C of the drum 12, or two ridges 41 for two chordal distances C.

With reference to FIGS. 6 and 9, each of the segments 51 comprises a base 52, one full elevated ridge 53 and a partial elevated ridge 53'. Base 52 has a mounting surface 52*a* the arcuate length of which is identical to mounting surface 42*a*, and an upper surface 52*b* from which the ridges 53, 53' project. The thickness or radial height of base 52 is represented by A'.

Each of the ridges 53, 53' projects a radial distance B'. Ridge 53 has substantially flat symmetrical sides 53*a*, 53*b* each of which subtends an angle $\theta'$ with the true radius R, and a flat top surface 53*c*. Ridge 53' has an identically angled side 53*a* and a side 53*b* which lies on a true radius of shell 12. Ridge 53' also has a flat top surface 53*c'* which is partial when compared with the full top surface 53*c*.

As constructed, and as particularly shown in FIG. 6, the segments 51 are mounted front to back and back to front in alternating relation, so that the sides 53*b'* of adjacent segments are disposed side by side to define a full elevated ridge 53. The two adjacent partial top surfaces 53*c'* together substantially correspond to a full flat top surface 53*c*. The spacing between the elevated ridges 53 is such that two of the chordal distances C emcompass three elevated ridges.

Each of the segments 61 comprises a base 62 and two ridges 63 which project symmetrically from the upper surface 62*b* of base 62. The mounting surface 62*a* is identical in length and curvature to the surfaces 42*a*, 52*a*.

The thickness of base 62 is greater than the thickness of both bases 42 and 52, and is represented by A". The lifting dimension of the ridges 63, however, is less than that of ridges 43, 53, and is represented by B". The ridges 63 have rounded sides, blending smoothly into the rounded upper base surface or top 62*b* and defining a sinusoidal pattern. Although rounded, the ridge sides generally subtend an angle $\theta''$ with a true radius R of the shell 12, which angle is greater than $\theta$ and $\theta'$.

With specific reference to FIG. 7, it will be noted that the ridges 63 of a given segment are so spaced that, when the segment is mounted adjacent another segment, all of the ridges 63 are equidistantly spaced. This is accomplished by providing a half recess on the outboard side of each ridge 63 which combines with an adjacent half recess to define a full recess.

Also as shown in FIG. 7, there are two full ridges 63 within liner section 34 for the same chordal distance C, or four ridges 63 for two of the chordal distances C.

As described, it will be apparent from the foregoing that the liner sections 32–34 differ from each other in several important respects. First, although not necessarily in order of importance, is the number of ridges in each liner section, which also may be viewed as the number of ridges in a uniform chordal distance. For substantially the same diameter, liner section 32 has the least number of ridges, and each of the liner sections 33, 34 has progressively more ridges. This is necessary because the ore fragments are largest when they enter the mill 11, and more space is thus required between the ridges 43. As the ore becomes more fragmented during the comminution process, lesser space is needed between ridges, and an increased number of ridges assists in carrying the ore fragments upwardly.

Second, the lifting dimension B of the ridges 43 of liner section 32 is greater than the lifting dimensions B' and B" of liner sections 33 and 34, respectively. Again, the size of the ore fragments as they enter the mill 11 requires a greater projection or lifting dimension on the part of the ridges 43, permitting the fragments to be carried upwardly as the mill rotates. After the initial stage of comminution, the lifting dimension is decreased in accordance with ore fragment size.

Third, the lifting angle $\theta$ is at a minimum within the liner section 32, with the angles $\theta'$ and $\theta''$ increasing progressively. The smaller the lift angle, the more nearly it approaches a true radius of the shell 12, which permits the ridge to carry the ore fragments higher as the shell rotates. As the angle increases, there is a greater tendency of the ore fragments to fall off the ridge earlier; and, in the case of liner section 33, the increased lift angle results in more of a tumbling action than the lifting and dropping of ore fragments which occurs with liner section 32; and the configuration of liner section 34 results in a more rolling movement of the ore fragments and balls.

Fourth, the thickness A of liner segments 41 is at a minimum, and this dimension increases for the liner sections 33 and 34, as shown at A' and A", respectively. Increasing the thickness of the base slightly reduces the average inside diameter of the liner section. Since circumferential velocity is a direct function of diameter size, it follows that the ore fragments travel at a greater speed within liner section 32, and this speed progressively decreases for the liner sections 33, 34. It is believed that this difference in circumferential velocity is at least partly responsible for migration of the ore fragments from one liner section to another in the forward direction (inlet to outlet) as the ore is comminuted.

This difference or variation between liner sections may also be characterized in terms of the ratio of the lifting dimension of the elevated ridges of each liner section to the base thickness of the associated section. Since the lifting dimension decreases from section to section, whereas the base thickness increases, the ratio of these dimensions decreases from section to section; i.e., B/A is greater than B'/A', which is greater than B"/A".

Last, the configuration of the ridges is generally more angular for liner sections 32 and 33, and becomes rounded for liner section 34. This facilitates the falling, tumbling and rolling movement of ore fragments within each liner section.

Preferably, the liner segments 41, 51, 61 are formed from material which is resistant to abrasion, a typical example of which is martensitic steel. Although such materials may not be as resistant to impact, it has been found that the extremely hard, abrasion-resistant characteristic enables the segment to wear longer over long periods of use.

It is also possible to employ a composite approach to each of the individual segments, such as that disclosed in U.S. Pat. No. 4,046,326 entitled "Shell Liner Assembly," and which issued to Darrell R. Larsen on Sept. 6, 1977. With this approach, a segment body is provided of material which has a greater resistance to impact but is lesser resistant to abrasion. One or more wedge-shaped wear inserts are uniquely secured with the segment body to the liner shell in a position of exposure to the ore fragments during comminution. In another approach, which is disclosed in a patent application of Darrell R. Larsen filed on Aug. 11, 1978 under Ser. No. 932,711, entitled "Shell Liner Assembly for Ore Grinding Mills", the abrasion-resistant wear insert takes the form of a cap which is connected directly to the segment body, the latter being connected directly to the liner shell.

The material of both the segment bodies and wear inserts for these composite structures is preferably martensitic steel, which can be heat treated to be either impact resistant, or highly resistant to abrasion. The procedures for obtaining these performance characteristics are well known in the metallurgical art. Another suitable example of an abrasion resistant material from which the individual segments may be formed is martensitic white iron.

Preferably, the balls used with the multiple zone liner assembly are also formed from martensitic steel, but they are heat treated to be somewhat more resistant to impact than the individual liner segments, and not quite as resistant to abrasion. As such, the balls tend to wear slightly faster than the individual liner segments, and they gradually become reduced in size. As discussed below, this works to an advantage by reason of the inherent migration of smaller balls to the downstream zones where smaller ore fragments are comminuted.

Operation of the mill 11 is substantially continuous, with ore fragments 19 supplied by conveyor 21 through chute 18 to the axial inlet of the drum 12. A fresh charge of uniform sized balls is added intermittently as the balls in use become worn and reduced in size to the point that they are no longer useful.

With specific reference to FIGS. 5, 8 and 11, the large ore fragments are initially subjected to comminution in the first zone, which is defined by liner section 32. As described above, each of the segments 41 of liner section 32 imparts substantial lift to the ore fragments as the drum 12 rotates, by reason of the lifting dimension B and the lift angle $\theta$. Because of these factors, the ore fragments and the balls are lifted upward a significant vertical distance by rotation of the drum 12, and ultimately are dropped onto the fragments and balls below. This results in crushing and breaking of the fragments by impact with other fragments and balls. The resulting profile of the mass within the drum 12 generally takes the form of a kidney, and is schematically represented in FIG. 11.

In the second zone, which is defined by liner section 33 (FIGS. 6, 9 and 12), the reduced ore fragments are subjected to communication by the segments 51, which include a greater number of elevated ridges 53 than the number of ridges 43. However, each of the ridges 53 has a lesser lifting dimension B′ and a lifting angle $\theta'$ which permits the ore fragments to slide off more readily. Consequently, these smaller ore fragments are not carried as high as in the first comminuting zone as the drum 12 rotates. As a result, there is more of a tumbling action by the balls and ore fragments, and size reduction is by the rock particles being "nipped" by the balls. The resulting kidney profile is moderated relative to the first zone, as shown in FIG. 12.

In the third comminuting zone, liner section 34 defines an increased number of elevated ridges 63, each of which has a lesser lifting dimension B″ and an increased lift angle $\theta''$. Coupled with the rounded profile of each ridge 63, the smaller ore fragments are carried upward a lesser vertical distance than in the prior zones, and comminution results from ball-to-ball rolling abrasion on the fragments. As shown in FIG. 13, the mass profile is further moderated, although it continues to be substantially kidney shaped.

The small comminuted rock particles leave the third comminuting zone and drum 12 through the axial outlet 22.

As described above, migration of the ore fragments and balls from one zone to the next is inherent with reduction in size. This results in classification of larger balls with larger fragments in the first zone, intermediate balls and fragments in the second zone and the smallest balls and fragments in the third zone. This migration results in a substantial increase in efficiency of the comminution process, since there is a minimum amount of intermixture of ore fragments and balls of different size within each zone.

Each of the ridges 43, 53, 63 is symmetrical in profile, as shown in FIGS. 8–10. This is not a necessity, but it is advantageous because it enables the direction of rotation of drum 12 to be reversed after the lifting faces have become worn in one direction. The symmetrical approach also increases the amount of material in the segment, which also increases life of the liner section.

As described, the multiple zone liner assembly performs a significant size reduction in ore fragments between the inlet and outlet, and also is of increased efficiency as compared with existing processes, as measured by total throughput per kilowatt hour.

What is claimed is:

1. A multiple zone liner system for the cylindrical shell of a ball mill having an inlet at one axial end and an outlet at the other, the liner system comprising:

(a) a plurality of liner sections constructed for mounting on the inner shell surface in sequential relation relative to the shell rotational axis, each liner section defining a comminution zone;

(b) each liner section formed with a plurality of elevated ridges extending in general alignment with the shell axis and circumferentially spaced therearound to define a comminuting surface;

(c) each ridge defining a lifting surface that is disposed at a predetermined angle relative to a radius of the shell, and each ridge having a predetermined lifting dimension;

(d) the number of rodges of each liner section increasing from section to section from the inlet to the outlet;

(e) the angle of the lifting surfaces of the ridges increasing from section to section from the inlet to the outlet;

(f) and the lifting dimension of the ridges being substantially constant in each section but decreasing from section to section from the inlet to the outlet.

2. The liner system defined by claim 1, wherein the elevated ridges of each liner section are equiangularly spaced.

3. The liner system defined by claim 1, wherein the liner sections are of equivalent axial length.

4. The liner system defined by claim 1, wherein each liner section comprises a plurality of liner segments.

5. The liner system defined by claim 4, wherein the liner segments of each section are structurally identical.

6. The liner system defined by claim 4, wherein each liner segment defines a mounting surface and a comminuting surface, and is secured to the shell by fastening means.

7. The liner system defined by claim 4, wherein each liner segment comprises a body defining a base and at least one elevated ridge projecting therefrom.

8. The liner system defined by claim 7, wherein the thickness of the base of each segment body is substantially constant in each section, said base thickness increasing from section to section from the inlet to the outlet.

9. The liner system defined by claim 8, wherein the ratio of the lifting dimension to the base thickness decreases from section to section from the inlet to the outlet, whereby the effective inside diameter of the liner sections decreases from section to section from the inlet to the outlet.

10. The liner system defined by claim 1, which comprises three liner sections.

11. The liner system defined by claim 10, wherein each elevated ridge of the first liner section has a substantially flat lifting surface, and terminates in a flat top surface.

12. The liner system defined in claim 10, wherein each elevated ridge of the second liner section has a substantially flat lifting surface, and terminates in a flat top surface.

13. The liner system defined by claim 10, wherein each elevated ridge of the third liner section has a curved lifting surface that merges smoothly into a rounded top.

14. The liner system defined by claim 10, wherein the first liner section comprises a plurality of identical liner segments, each segment comprising a body defining a base and one elevated ridge projecting therefrom.

15. The liner system defined by claim 14, wherein the ridge is disposed within the segment body so that uniformly positioned adjacent segments define equidistantly spaced elevated ridges with equidistantly spaced recesses therebetween.

16. The liner system defined by claim 10, wherein the second liner section comprises a plurality of identical liner segments, each segment comprising a body defining a base and having one full and one-half ridge projecting therefrom.

17. The liner system defined by claim 16, wherein the full and half ridges are so disposed within the segment body that alternately positioned segments define full, equidistantly spaced ridges with equidistantly spaced recesses therebetween.

18. The liner system defined by claim 10, wherein the third liner section comprises a plurality of identical liner segments, each segment comprising a body defining a base and having two ridges projecting therefrom.

19. The liner system defined by claim 18, wherein the two ridges are so disposed within the segment body that uniformly positioned segments define equidistantly spaced ridges with equidistantly spaced recesses therebetween.

20. The liner system defined by claims 15, 17 or 19, wherein the lifting surfaces of each elevated ridge merge smoothly into the associated base.

21. The liner system defined by claims 15, 17 or 19, wherein the elevated ridges are symmetrical in cross section.

22. The liner system defined by claim 10, wherein, for a given chordal distance of the shell, the first liner section defines two elevated ridges, the second liner section defines three elevated ridges, and the third liner second defines four elevated ridges.

23. The liner system defined by claim 1, wherein the elevated ridges of each liner section are symmetrical in cross section.

24. The liner system defined by claim 1, wherein each liner section is formed from material that is resistant to abrasion.

25. The liner system defined by claim 24, wherein the liner section material is martensitic steel.

26. A multiple zone liner system for the cylindrical shell of a ball mill having an inlet at one axial end and an outlet at the other, the liner system comprising:

(a) a plurality of liner sections constructed for mounting on the inner shell surface insequential relation relative to the shell rotational axis, each liner section defining a comminution zone;

(b) each liner section comprising a base of predetermined substantially constant thickness, the base thickness increasing from section to section from the inlet to the outlet;

(c) each liner section further comprising a plurality of elevated ridges projecting from the associated base and extending in general alignment with the shell access, the elevated ridges being circumferentially spaced around the liner section to define a comminuting surface;

(d) each ridge defining a lifting surface that is disposed at a predetermined angle relative to a radius of the shell, and each ridge having a predetermined lifting dimension;

(e) the number of ridges of each liner section increasing from section to section from the inlet to the outlet;

(f) the angle of the lifting surfaces of the ridges increasing from section to section from the inlet to the outlet;

(g) and the lifting dimension of the ridges decreasing from section to section from the inlet to the outlet.

* * * * *